US005681449A

United States Patent [19]

Yokoyama et al.

[11] Patent Number: 5,681,449

[45] Date of Patent: Oct. 28, 1997

[54] PROCESS FOR PRODUCING OIL FROM ORGANIC MATERIAL-CONTAINING SLUDGE

[75] Inventors: Shinya Yokoyama, Tsukuba; Michio Kuriyagawa, Tsuchiura; Tomoko Ogi, Tsukuba; Hideo Kobayashi, Tsukuba; Tomoaki Minowa, Tsukuba; Seiichi Inoue, Tsukuba; Norio Tenma, Kashiwa, all of Japan

[73] Assignee: Director-General Of Agency Of Industrial Science And Technology, Japan

[21] Appl. No.: 584,462

[22] Filed: Jan. 11, 1996

[30] Foreign Application Priority Data

Jan. 18, 1995 [JP] Japan ..... 7-005713

[51] Int. Cl.[6] ..... C10G 17/00

[52] U.S. Cl. ..... 208/13; 585/240

[58] Field of Search ..... 585/240; 208/13

[56] References Cited

U.S. PATENT DOCUMENTS

| | | | |
|---|---|---|---|
| 4,089,773 | 5/1978 | Espensheid | 585/240 |
| 4,387,030 | 6/1983 | Sauder | 585/240 |
| 4,812,225 | 3/1989 | Corte | 585/240 |

FOREIGN PATENT DOCUMENTS

| | | | |
|---|---|---|---|
| 0105079 | 6/1984 | Japan | 585/240 |

*Primary Examiner*—Helane Myers
*Attorney, Agent, or Firm*—Lorusso & Loud

[57] ABSTRACT

An organic material-containing sludge is fluidized and is heat-treated at a high pressure in a reactor disposed underground to obtain an oil having a high calorific value. The heat treatment may be performed using an electrical energy, the terrestrial heat or a reaction heat obtained by oxidative treatment of similer sludge.

7 Claims, 2 Drawing Sheets

PROCESS FOR PRODUCING OIL FROM ORGANIC MATERIAL-CONTAINING SLUDGE

BACKGROUND OF THE INVENTION

This invention relates to a process for producing an oil from an organic material-containing sludge.

Sewage sludge containing organic materials is increasingly produced from cities and is one of the serious social problems. One recently developed method of treating sludge includes the incineration thereof after dehydration. Since the dehydrated sludge still has a water content of about 80% by weight, however, a large amount of auxiliary fuel must be used for the incineration treatment.

JP-B-5-5560 discloses a method of treating an organic material-containing sludge having a water content of below 85% by weight in which the sludge is heated at a temperature of 300°–320° C. and a pressure higher than the saturated water vapor pressure, typically 120 atm, for 5–180 minutes to obtain an oily product having a calorific value of about 8,000 Kcal/kg. This process is promising in that the energy recovered as the oil from the sludge is greater than that consumed during the treatment. From the standpoint of actual practice on an industrial scale, however, the process efficiency is not satisfactory.

SUMMARY OF THE INVENTION

It is, therefore, the prime object of the present invention to provide a process which can efficiently produce a hydrocarbon oil from an organic material-containing sludge.

In accordance with one aspect of the present invention there is provided a process for treating an organic material-containing solid sludge having a water content of 70–85% by weight, which includes the steps of:

heating the solid sludge at a temperature of 150°–240° C. and a pressure higher than the saturated water vapor pressure to fluidize the solid sludge and to obtain a fluidized sludge;

providing a reactor including an outer cylindrical member vertically extending underground and closed at the bottom thereof, and an inner cylindrical member defining an inner fluid passage therein and disposed within the outer cylindrical member to define an annular, outer fluid passage therebetween, the inner cylindrical member being open ended at a lower portion of the outer cylindrical member so that the inner fluid passage being in fluid communication with the outer fluid passage;

feeding the fluidized sludge to the inner fluid passage and passing the fluidized sludge downward therethrough;

electrically heating the fluidized sludge in a lower portion of the inner fluid passage at a temperature of 250°–350° C. and a pressure of 30–200 atm to convert the organic material contained in the fluidized sludge into an oil, so that an oil-containing product is formed;

passing the oil-containing product upward through the outer fluid passage and discharging same from the reactor; and separating the oil from the oil-containing product.

In another aspect, the present invention provides a process for treating an organic material-containing solid sludge having a water content of 70–85% by weight, which includes the steps of:

heating the solid sludge at a temperature of 150°–240° C. and a pressure higher than the saturated water vapor pressure to fluidize the solid sludge and to obtain a fluidized sludge;

providing a reactor including an outer cylindrical member vertically extending underground, such that the outer cylindrical member is heated by the terrestrial heat, and closed at the bottom thereof, and an inner cylindrical member defining an inner fluid passage therein and disposed within the outer cylindrical member to define an outer fluid passage therebetween, the inner cylindrical member being open ended at a lower portion of the outer cylindrical member so that the inner fluid passage being in fluid communication with the outer fluid passage;

feeding the fluidized sludge to the outer fluid passage and passing the fluidized sludge downward therethrough;

heating the fluidized sludge with the terrestrial heat at a temperature of 250°–350° C. and a pressure of 30–200 atm to convert the organic material contained in the fluidized sludge into an oil, so that an oil-containing product is formed;

passing the oil-containing product upward through the inner fluid passage and discharging same from the reactor; and separating the oil from the oil-containing product.

The present invention also provides a process for treating an organic material-containing solid sludge having a water content of 70–85% by weight, which includes the steps of:

heating the solid sludge at a temperature of 150°–240° C. and a pressure higher than the saturated water vapor pressure to fluidize the solid sludge and to obtain a fluidized sludge;

providing a reactor including a first, outermost cylindrical member vertically extending underground and closed at the bottom thereof, three, second through fourth cylindrical members having diameters decreasing in the order from the second to fourth cylindrical members, each of the second through fourth cylindrical members being made of a heat conductive material and coaxially disposed within the first cylindrical member, so that first through fourth fluid passages are defined between the first and second cylindrical members, between the second and third cylindrical members, between the third and fourth cylindrical members and within the fourth cylindrical member, respectively, and a bottom partition extending from the lower end of the second cylindrical member to the lower end of the fourth cylindrical member so that the first fluid passage is in fluid communication with the fourth fluid passage and the second fluid passage is in fluid communication with the third fluid passage;

feeding the fluidized sludge to one of the first through fourth fluid passages, passing the fluidized sludge downward therethrough and upward through the corresponding fluid passage which is in fluid communication therewith;

introducing a heat transfer medium into such remaining one of the first through fourth fluid passages that is not fed with the fluidized sludge;

so that the fluidized sludge is heated at a temperature of 250°–350° C. and a pressure of 30–200 atm by heat exchange with the heat transfer medium within the reactor and the organic material contained in the fluidized sludge is converted into an oil to form an oil-containing product; and separating the oil from the oil-containing product.

BRIEF DESCRIPTION OF THE DRAWINGS

Other objects, features and advantages of the present invention will become apparent from the detailed description of the preferred embodiments of the invention which follows, when considered in light of the accompanying drawings, in which.

DETAILED DESCRIPTION OF THE PREFERRED EMBODIMENTS OF THE INVENTION

The organic material-containing sludge to be treated by the process of the present invention is in the form of a solid having a water content of 70–85% by weight and may be, for example, a sewage sludge discharged from a sewage treatment plant, a sludge produced by the biological treatment of organic wastes or garbage discharged from homes, restaurants, food shops, manufactories, etc. When the sludge has a water content higher than 85% by weight, it is necessary to dehydrate the sludge. The dehydration can be carried out by mixing the sludge with a high molecular weight coagulant and then separating water from the mixture by, for example, vacuum dehydration, belt press dehydration, centrifugal dehydration or thermal dehydration using a multi-effect evaporator.

The solid sludge is first heated at a temperature of at least 150°–250° C., preferably 200°–225° C., and a pressure higher than the saturated water vapor pressure to fluidize the solid sludge. The heat treatment time is generally 15–100 minutes. The resulting fluidized sludge is preferably stored in a storage tank as a feed stock.

To expedite the fluidization, it is preferred that an alkaline substance, such as an alkali metal compound or an alkaline earth metal compound, be incorporated into the solid sludge. The amount of the alkaline substance is generally up to 20% by weight, preferably up to 5% by weight, based on the weight of the solid sludge on the dry basis. Illustrative of suitable alkaline substances are sodium hydroxide, potassium hydroxide, sodium carbonate, potassium carbonate, sodium bicarbonate, potassium bicarbonate, sodium formate, calcium oxide, calcium hydroxide and magnesium hydroxide.

The fluidized sludge is then heat treated at a temperature of 250°–350° C., preferably 275°–325° C., and a pressure of 30–200 atm, preferably 60–130 atm, to convert the organic material contained in the fluidized sludge into an oil.

Similar to the above fluidization treatment, an alkaline substance may be advantageously added to the fluidized sludge to expedite the conversion of the organic material into oils. The amount and kind of the alkaline substance are the same as described above.

One of the features of the present invention resides in that the conversion reaction is carried out in a reactor extending deeply underground. By this expedient, the fluidized sludge is subjected to a high pressure by its own weight so that it is not necessary to apply an external pressure thereto or it is possible to considerably reduce the external pressure applied thereto. Further, even if the contents in the reactor leak out, no problems of environmental pollution are caused.

Figure 1:
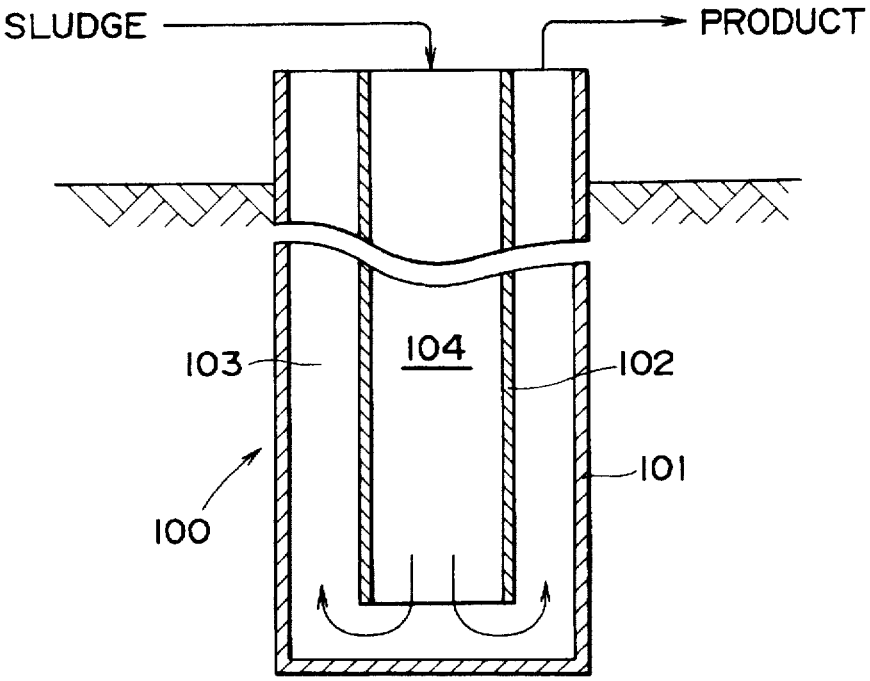
FIG. 1 is a cross-sectional elevational view diagrammatically showing an embodiment of a reactor useful for carrying out the process of the present invention.

Referring to FIG. 1, designated generally as 100 is a reactor for carrying out the conversion reaction. The reactor 100 includes an outer cylindrical member 101 vertically extending underground and closed at the bottom thereof. An inner cylindrical member 102 formed of a heat conductive material and defining an inner fluid passage 104 therein is disposed, generally coaxially, within the outer cylindrical member 101 so that an annular, outer fluid passage 103 is defined therebetween. The inner cylindrical member 102 is open ended at a lower portion of the outer cylindrical member 101 so that the inner fluid passage 104 is in fluid communication with the outer fluid passage 103.

In one embodiment, the fluidized sludge is fed through the top of the inner cylindrical member 102 to the inner fluid passage 104 and flows down therethrough, as shown in FIG. 1. An electric heater (not shown) is provided in a lower part of the inner fluid passage 104 so that the fluidized sludge is electrically heated to convert the organic material contained in the fluidized sludge into an oil. The heater and lead wires for supplying electric power thereto can be embedded within the wall of the inner cylindrical member 102. The oil-containing product then enters the outer fluid passage 103, flows upward therethrough and is, then, discharged from the reactor 100 through the top thereof. During the downward movement of the fluidized sludge through the inner fluid passage 104, the sludge is heated by indirect heat exchange with the oil-containing product flowing upward through the outer fluid passage 103. The length of that portion of the outer cylindrical member 101 which is present underground is generally 300–2,000 m, preferably 600–1,300 m.

In another embodiment, the fluidized sludge is heated with the terrestrial heat. The terrestrial heat is generally obtained at a depth of 1,000 m or more. Thus, the length of that portion of the outer cylindrical member 101 which is present underground is generally 1,000 m or more. If necessary, an auxiliary electric heater may be additionally used. In this embodiment, to effectively utilize the earth heat, the conversion reaction is carried out in the outer fluid passage 103. The outer cylindrical member 101 should be made of a heat conducting material.

Thus, the fluidized sludge is fed to the outer fluid passage 103 and flows down therethrough. In a lower part of the passage 103, the sludge is heated with the terrestrial heat to convert the organic material contained in the fluidized sludge into an oil. The oil-containing product then enters the inner fluid passage 104, flows upward therethrough and is, then, discharged from the reactor 1 through the top thereof. During the downward movement of the fluidized sludge through the outer fluid passage 103, the sludge is also heated by indirect heat exchange with the oil-containing product flowing upward through the inner fluid passage 104.

Figure 2:
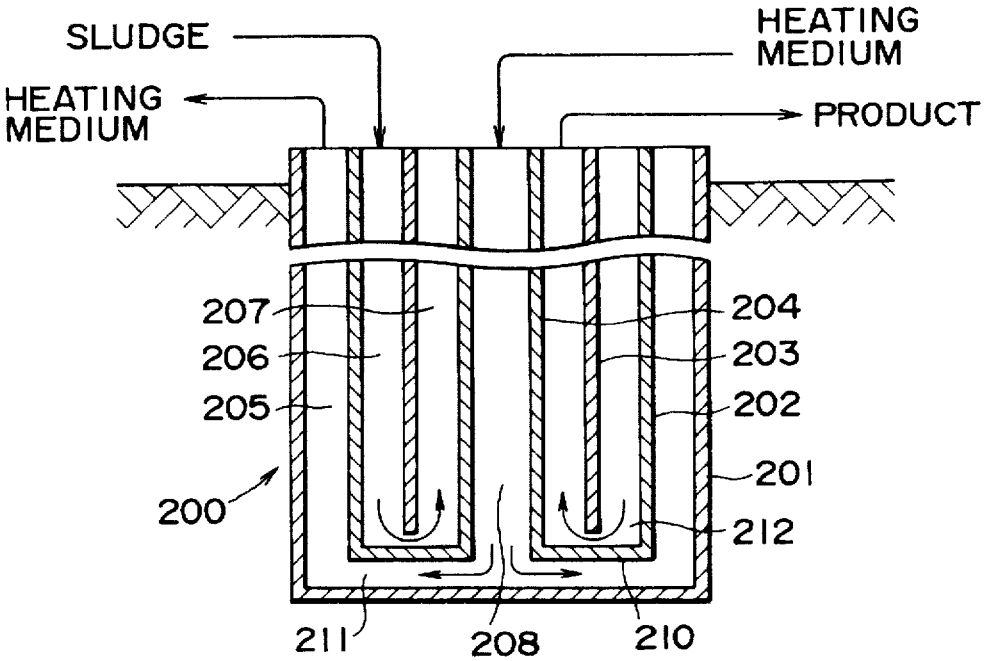
FIG. 2 a cross-sectional elevational view diagrammatically showing another embodiment of a reactor for carrying out the process of the present invention.

In a further embodiment, the conversion reaction is performed using the heat of a heat transfer medium. Referring to FIG. 2, designated generally as 200 is a reactor for carrying out the conversion reaction. The reactor 200 has a first, outermost cylindrical member 201 vertically extending underground and closed at the bottom thereof. Disposed coaxially within the first cylindrical member 201 are three, second through fourth cylindrical members 202, 203 and 204 having diameters decreasing in the written order so that first through third annular fluid passages 205, 206 and 207 are defined between the first and second cylindrical members 201 and 201, between the second and third cylindrical members 202 and 203 and between the third and fourth cylindrical members 203 and 204, respectively and a central fluid passage 208 is defined within the fourth cylindrical member 204. Each of the second through fourth cylindrical members 201 through 204 is made of a heat conductive material. The length of that portion of the outer cylindrical member 201 which is present underground is generally 300–2,000 m, preferably 600–1,300 m.

An annular bottom partition 210 extends radially from the lower end of the second cylindrical member 202 to the lower end of the fourth cylindrical member 204 so that the first fluid passage 205 is in fluid communication with the fourth fluid passage 208 and the second fluid passage 206 is in fluid communication with the third fluid passage 207. In other words, there are formed two, first and second independent fluid flow paths 211 and 212 in the apparatus 200. The first path includes the first and fourth fluid flow passages 205 and 208, while the second path includes the second and third fluid flow passages 206 and 207.

The fluidized sludge is fed to one of the first through fourth fluid passages 205–208 (second passage 206 in the illustrated embodiment), flows down therethrough, enters the corresponding fluid passage (third passage 207 in the illustrated embodiment) which is in fluid communication therewith and flows upward through this corresponding fluid passage. On the other hand, a heat transfer medium is introduced into such one of the first through fourth fluid passages 205–208 (fourth passage 208 in the illustrated embodiment) that is not fed with the fluidized sludge, flows down therethrough, enters the corresponding fluid passage (first passage 205 in the illustrated embodiment) and flows upward through this corresponding passage.

Namely, the fluidized sludge is fed to one of the first and second fluid flow paths 211 and 212 (the first path 211 in the illustrated embodiment), while the heat transfer medium is fed to the other fluid flow path (the second fluid flow path 212 in the illustrated case).

As a consequence, the fluidized sludge is heated by heat exchange with the heat transfer medium within the reactor and the organic material contained in the fluidized sludge is converted into an oil to form an oil-containing product.

Preferably, the heat transfer medium is introduced into the fourth fluid passage 208 and is discharged from the reactor through the first fluid passage 205 (as shown in FIG. 2), with the fluidized sludge being fed to the second passage 206 (as shown in FIG. 2) or to the third passage 207. The former embodiment is advantageous from the standpoint of heat exchange efficiency.

The heat transfer medium may be an oil such as a diphenyl compound, triphenyl compound or alkylnaphthalene compound, or an aqueous fluid such as superheated steam, -highly pressurized hot water or a reaction product obtained by oxidizing an organic material-containing sludge.

There is known a method for the oxidative treatment of an organic material-containing sludge or a fluidized product thereof by treatment with oxygen at a temperature of 180°–330° C. and an oxygen pressure of 90–150 atm. The oxygen is generally used in an amount of 0.5–1% by weight based on the weight of the sludge. In this case, the reaction product obtained has a temperature of 150°–300° C. Accordingly, this product can be suitably used as the heat transfer medium.

In a further preferred embodiment, the two different processes of the oxidative treatment of an organic material-containing sludge and the production of an oil from the sludge are simultaneously performed using the reactor shown in FIG. 2. Namely, one of the two fluid flow paths 211 and 212 is used for the oxidative treatment, while the other fluid flow path is used for the production of an oil.

For example, an organic material-containing sludge or a fluidized product thereof is fed, together with an oxygen gas, to the fourth fluid flow passage 208 of the first fluid flow path 211 and heated with an electric heater (not shown) in a lower portion thereof under conditions as described above, thereby to oxidize the organic materials contained therein. At the same time, the fluidized sludge is fed to the second fluid flow passage 206 of the second fluid flow path 212 and heated by indirect heat exchange with the oxidation product flowing through the first fluid flow path 211. Thus, in this embodiment, the reaction mixture of the sludge with oxygen is used as a heating medium.

Figure 3:
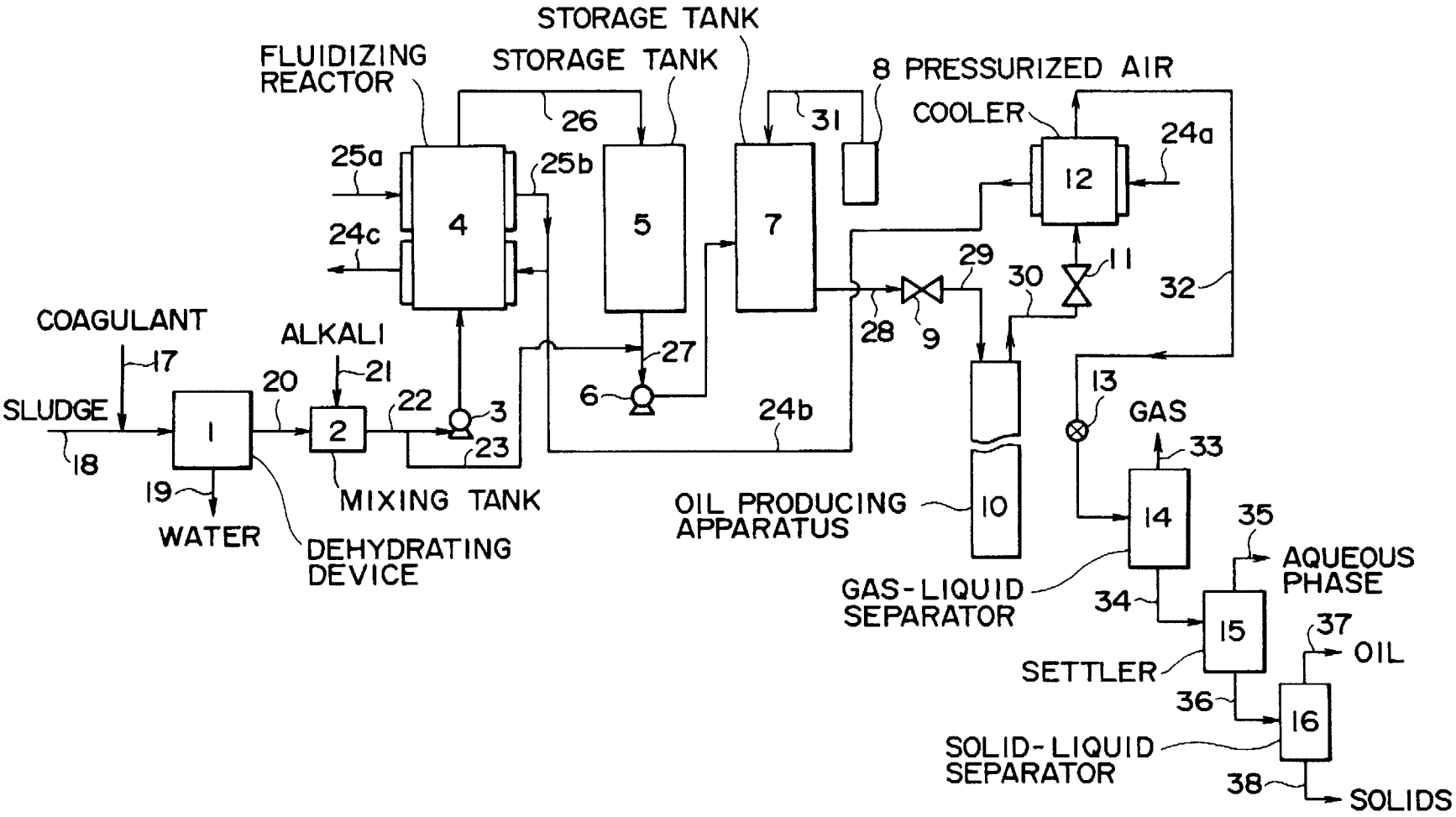
FIG. 3 is a flow diagram schematically illustrating the whole system for performing the sludge treatment according to the present invention.

FIG. 3 depicts the flow diagram of an example of the oil production system.

An organic material-containing sludge is fed through a line 18 and is fed, after being mixed with a polymer coagulant supplied through a line 17, to a dehydrating device 1. Separated water is discharged from the device 1 through a line 19 and is fed to a water disposal zone, whereas the dehydrated, clayey sludge having a water content of 70–85% by weight is introduced through a line 20 into a mixing tank 2 where it is mixed with an alkaline substance supplied through a line 21. The mixture is then fed through a line 22 and a pump 3 to a fluidization reactor 4. When the sludge to be treated is in the form of a fluid, such as in the case of an alcohol fermentation waste, e.g. a molasses waste liquor, it is not necessary to feed the mixture to the fluidization reactor 4; i.e. the mixture is directly fed to a pressurized tank 7 through a line 23.

In the fluidization reactor 4, the mixture is preheated by indirect heat exchange with a heat transfer medium supplied through a line **24*b* and is heated to 150°–240° C. by heat exchange with a heat transfer medium supplied through a line 25*a*, so that the mixture is fluidized. The medium discharged through a line 25*b* is mixed with the medium supplied through the line 24*b***.

The fluidized sludge is fed through a line 26 to a feed stock storage tank 5 and is then passed through a line 27 and a pump 6 to the pressurized tank 7 to which a pressure is applied from a high pressure gas source 8, such as a pressurized air or nitrogen, through a line 31. The fluidized sludge is then fed through a line 28, a flow rate Control valve 9 and a line 29 to an oil producing apparatus 10. Details of the apparatus 10 is as described with reference to FIGS. 1 and 2.

The oil-containing product produced in the apparatus 10 is discharged therefrom and is introduced through a line 30 and a pressure control valve 11 into a cooling device 12, where it is cooled by indirect heat exchange with a heat transfer medium supplied through a line **24*a*. The cooled product is fed through a line 32 to a flush valve 13 and is then introduced to a gas-liquid separator 14. The gas separated is fed to a gas treating zone through a line 33, while the liquid in the form of a slurry is passed through a line 34 to a first separating zone 15 such as a settler or a centrifuge where the slurry is separated into an aqueous phase and an oil-containing high density slurry phase- The aqueous phase is fed to a water treatment zone through a line 35 while the slurry phase is fed through a line 36 to a second separation zone 16 such as screw press, a filtering device or the like solid-liquid separator. Thus, the slurry phase is separated into an oily product and solids. The oily product is recovered through a line 37. The solids are discharged through a line 38** and are subjected to an incineration treatment, a reclamation or any other suitable treatment. The oily product has a calorific value of above 8,000 kcal and may be used as a fuel. The yield of the oily product is about 50% by weight based on the total organic matter content of the sludge.

The following example will further illustrate the present invention. Percentages are by weight.

EXAMPLE

A sewage sludge (water content: about 98%) obtained by an activated sludge process was mixed with a polymeric coagulant and the mixture was dehydrated to obtain a clayey sludge (water content: about 81%). This was placed in a 300 ml autoclave. After pressurization with a nitrogen gas to 30 atm, the autoclave was heated in an electric oven to 175° C. and maintained at that temperature for 1 hour to obtain a fluidized sludge. The fluidized sludge (about 100 g) was placed in a 300 ml autoclave (used as a substitute for an underground reactor) and heated at a temperature of 300° C. and a pressure of 100 atm for 5 minutes. The pressure was controlled by feeding a nitrogen gas to the autoclave. The reaction product in the form of a slurry was mixed with dichloromethane. The organic phase was separated and distilled to leave 8.2 g of an oily product having a viscosity at 25° C. of 690 cP and a calorific value of 8,900 kcal. The yield was 53% based on the sludge on dry basis.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all the changes which come within the meaning and range of equivalency of the claims are therefore intended to be embraced therein.

What is claimed is:

1. A process for treating an organic material-containing solid sludge having a water content of 70–85% by weight, comprising the steps of:

heating said solid sludge at a temperature of 150°–240° C. and a pressure higher than the saturated water vapor pressure to fluidize said solid sludge and to obtain a fluidized sludge;

providing a reactor comprising an outer cylindrical member vertically extending underground and closed at the bottom thereof, and an inner cylindrical member defining an inner fluid passage therein and disposed within said outer cylindrical member to define an annular, outer fluid passage therebetween, said inner cylindrical member being open ended at a lower portion of said outer cylindrical member so that said inner fluid passage being in fluid communication with said outer fluid passage;

feeding said fluidized sludge to said inner fluid passage and passing said fluidized sludge downward therethrough;

electrically heating said fluidized sludge in a lower portion of said inner fluid passage at a temperature of 250°–350° C. and a pressure of 30–200 atm to convert the organic material contained in said fluidized sludge into an oil, so that an oil-containing product is formed;

passing said oil-containing product upward through said outer fluid passage and discharging same from said reactor; and separating said oil from said oil-containing product.

2. A process for treating an organic material-containing solid sludge having a water content of 70–85% by weight, comprising the steps of:

heating said solid sludge at a temperature of 150°–240° C. and a pressure higher than the saturated water vapor pressure to fluidize said solid sludge and to obtain a fluidized sludge;

providing a reactor comprising an outer cylindrical member vertically extending underground, such that said outer cylindrical member is heated by the terrestrial heat, and closed at the bottom thereof, and an inner cylindrical member defining an inner fluid passage therein and disposed within said outer cylindrical member to define an outer fluid passage therebetween, said inner cylindrical member being open ended at a lower portion of said outer cylindrical member so that said inner fluid passage being in fluid communication with said outer fluid passage;

feeding said fluidized sludge to said outer fluid passage and passing said fluidized sludge downward therethrough;

heating said fluidized sludge with said terrestrial heat at a temperature of 250°–350° C. and a pressure of 30–200 atm to convert the organic material contained in said fluidized sludge into an oil, so that an oil-containing product is formed;

passing said oil-containing product upward through said inner fluid passage and discharging same from said reactor; and separating said oil from said oil-containing product.

3. A process for treating an organic material-containing solid sludge having a water content of 70–85% by weight, comprising the steps of:

heating said solid sludge at a temperature of 150°–240° C. and a pressure higher than the saturated water vapor pressure to fluidize said solid sludge and to obtain a fluidized sludge;

providing a reactor comprising a first, outermost cylindrical member vertically extending underground and closed at the bottom thereof, three, second through fourth cylindrical members having diameters decreasing in the order from said second to fourth cylindrical members, each of said second through fourth cylindrical members being made of a heat conductive material and coaxially disposed within said first cylindrical member, so that first through fourth fluid passages are defined between said first and second cylindrical members, between said second and third cylindrical members, between said third and fourth cylindrical members and within said fourth cylindrical member, respectively, and a bottom partition extending from the lower end of said second cylindrical member to the lower end of said fourth cylindrical member so that said first fluid passage is in fluid communication with said fourth fluid passage and said second fluid passage is in fluid communication with said third fluid passage;

feeding said fluidized sludge to one of said first through fourth fluid passages, passing said fluidized sludge downward therethrough and upward through the corresponding fluid passage which is in fluid communication therewith;

introducing a heat transfer medium into such remaining one of said first through fourth fluid passages that is not fed with said fluidized sludge;

so that said fluidized sludge is heated at a temperature of 250°–350° C. and a pressure of 30–200 atm by heat exchange with said heat transfer medium within said reactor and said organic material contained in said fluidized sludge is converted into an oil to form an oil-containing product; and separating said oil from said oil-containing product.

4. A process as claimed in claim 3, wherein said heat transfer medium is introduced into said fourth fluid passage and is discharged from said reactor through said first fluid passage.

5. A process as claimed in claim 4, wherein said heat transfer medium is a hot fluid obtained by the reaction of an organic material-containing sludge with oxygen.

6. A process as claimed in claim 4, wherein said heat transfer medium is a heated gas or liquid.

7. A process as claimed in claim 3, wherein said heat transfer medium is a feed including an oxygen gas and a fluid of an organic material-containing sludge and wherein said feed is heated during the passage thereof through said remaining fluid flow passage to react said organic material with said oxygen.

* * * * *

UNITED STATES PATENT AND TRADEMARK OFFICE

CERTIFICATE OF CORRECTION

PATENT NO. : 5,681,449

DATED : October 28, 1998

INVENTOR(S) : YOKOYAMA et al

It is certified that error appears in the above-indentified patent and that said Letters Patent is hereby corrected as shown below:

Col. 4, line 59, "201 and 201" should read --201 and 202--.

Col. 5, line 45, "-highly" should read --highly--.

Col. 6, line 36, "Control" should read --control--.

Col. 7, line 41, "being" should read --is--.

Col. 8, line 5, delete "being" insert --is--; and
line 29, delete "three,".

Signed and Sealed this

Twenty-seventh Day of October, 1998

*Attest:*

Bruce Lehman

BRUCE LEHMAN

*Attesting Officer*

*Commissioner of Patents and Trademarks*